US007637784B2

(12) United States Patent
Evans

(10) Patent No.: US 7,637,784 B2
(45) Date of Patent: Dec. 29, 2009

(54) DISK DRIVE INTERPOSER

(75) Inventor: Robert Franklin Evans, Bedford, NH (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 11/968,468

(22) Filed: Jan. 2, 2008

(65) Prior Publication Data

US 2008/0182431 A1 Jul. 31, 2008

Related U.S. Application Data

(60) Provisional application No. 60/887,066, filed on Jan. 29, 2007.

(51) Int. Cl.
*H01R 12/00* (2006.01)

(52) U.S. Cl. ..... 439/638; 439/928.1; 439/76.1

(58) Field of Classification Search ..... 439/638, 439/928.1, 76.1
See application file for complete search history.

(56) References Cited

U.S. PATENT DOCUMENTS 4,236,779 A 12/1980 Tang
5,519,571 A * 5/1996 Shieh ..... 361/685
5,673,171 A * 9/1997 Varghese et al. ..... 361/679.34
5,772,452 A 6/1998 Aoyama
6,050,831 A * 4/2000 Wu et al. ..... 439/76.1
6,176,743 B1 1/2001 Kuo
6,217,359 B1 * 4/2001 Chang ..... 438/297
6,293,827 B1 9/2001 Stokoe
6,343,957 B1 2/2002 Kuo et al.
6,364,713 B1 4/2002 Kuo
6,428,330 B1 * 8/2002 Poulter et al. ..... 439/76.1
6,722,897 B1 4/2004 Wu
6,776,659 B1 8/2004 Stokoe et al.
6,786,771 B2 9/2004 Gailus
6,830,483 B1 12/2004 Wu
6,869,292 B2 3/2005 Johnescu et al.
6,887,108 B2 * 5/2005 Wu ..... 439/638
6,932,618 B1 8/2005 Nelson
6,994,569 B2 2/2006 Minich et al.
6,997,736 B2 2/2006 Costello et al.
7,014,475 B1 * 3/2006 Mongold ..... 439/67

(Continued)

OTHER PUBLICATIONS

U.S. Appl. No. 11/627,110, filed Jul. 31, 2006, Steven E. Minich.

*Primary Examiner*—Truc T Nguyen
(74) *Attorney, Agent, or Firm*—Woodcock Washburn LLP

(57) ABSTRACT

A disk drive interposer may include a component board assembly, and an interconnect board. The component board assembly may have a plurality of electrical components electrically connected by a first set of electrically conductive traces. The interconnect board may have a first plurality of electrically-conductive pads disposed along a disk drive mating edge of the interconnect board and a second plurality of electrically-conductive pads disposed along a backplane mating edge of the interconnect board. The first plurality of pads may be electrically connected to the second plurality of pads by a second set of electrically conductive traces. A mezzanine connector may electrically connect the first set of traces and the second set of traces. Such an interposer may physically and electrically mimic a disk drive from the frame of reference of a backplane, and physically and electrically mimic a backplane from the frame of reference of a disk drive.

27 Claims, 4 Drawing Sheets

U.S. PATENT DOCUMENTS

| | | | | |
|---|---|---|---|---|
| 7,101,188 | B1 * | 9/2006 | Summers et al. | 439/59 |
| 7,163,421 | B1 | 1/2007 | Cohen et al. | |
| 7,494,383 | B2 | 2/2009 | Cohen et al. | |
| 2004/0072473 | A1 | 4/2004 | Wu | |
| 2005/0020103 | A1 | 1/2005 | Spink | |
| 2006/0064534 | A1 | 3/2006 | Lanus | |
| 2006/0068640 | A1 | 3/2006 | Gailus | |

* cited by examiner

DISK DRIVE INTERPOSER

CROSS-REFERENCE TO RELATED APPLICATIONS

This application claims benefit of 35 U.S.C. § 119(e) from provisional U.S. patent application No. 60/887,066, filed Jan. 29, 2007. The contents of the above-referenced U.S. patent application are incorporated herein by reference.

BACKGROUND

A disk drive assembly, such as may be found on a computer tower, for example, may include a backplane that is adapted to receive one or more computer hard disk drives. The backplane may include a respective electrical connector for each disk drive that the backplane is adapted to receive. Each disk drive may include a complementary electrical connector corresponding to the connector on the backplane that is adapted to receive the disk drive. Typically, the connectors on the backplane are plug connectors and the connectors on the backplane-mating side of the disk drive are receptacle connectors.

Each hard disk drive may be guided into the backplane via a rail system. For each disk drive, a pair of complementary rails extends along the inner sides of the disk drive assembly housing. The disk drives may be slid into the backplane along the rails. The disk drive may be "plugged in" by sliding the disk drive along the rails far enough for the disk drive connector to mate with the backplane connector.

Sometimes, it is desirable to program a disk drive for custom applications. Such programming often requires the use of custom hardware and software components. Accordingly, custom disk drives are typically required. Customizing disk drives for every application is expensive. It would be desirable, therefore, if a mechanism were available to enable manufacturers of such custom disk drives to use commercial, off-the-shelf disk drives for custom applications, and avoid the need for customizing the disk drives themselves.

SUMMARY

A disk driver interposer that may physically and electrically mimic a disk drive from the frame of reference of a backplane, and physically and electrically mimic a backplane from the frame of reference of a disk drive, is provided. Such an interposer may include a component board assembly, an interconnect board, at least one mezzanine connector electrically connecting the component board assembly and interconnect board, a plug housing having a cavity extending therethrough, a plurality of receptacle contacts, a receptacle housing, and a rail support cover.

The component board assembly may include a plurality of electrical components. The interconnect board may include a first plurality of electrically-conductive pads disposed along a disk drive mating edge of the interconnect board and a second plurality of electrically-conductive pads disposed along a backplane mating edge of the interconnect board. The interconnect board may extend into the cavity of the plug housing such that the first plurality of pads may be positioned in the cavity.

Each receptacle contact may be affixed to a respective one of the pads of the second plurality of pads. The receptacle contacts may also extend through the receptacle housing.

The rail support cover may include a rail support member having an opposing pair of distal ends, each of which may be adapted to slidingly engage a complementary rail, wherein the rail support cover may hold the component board assembly, the at least one mezzanine connector and the interconnect board together.

DETAILED DESCRIPTION OF ILLUSTRATIVE EMBODIMENTS

Figure 1A:
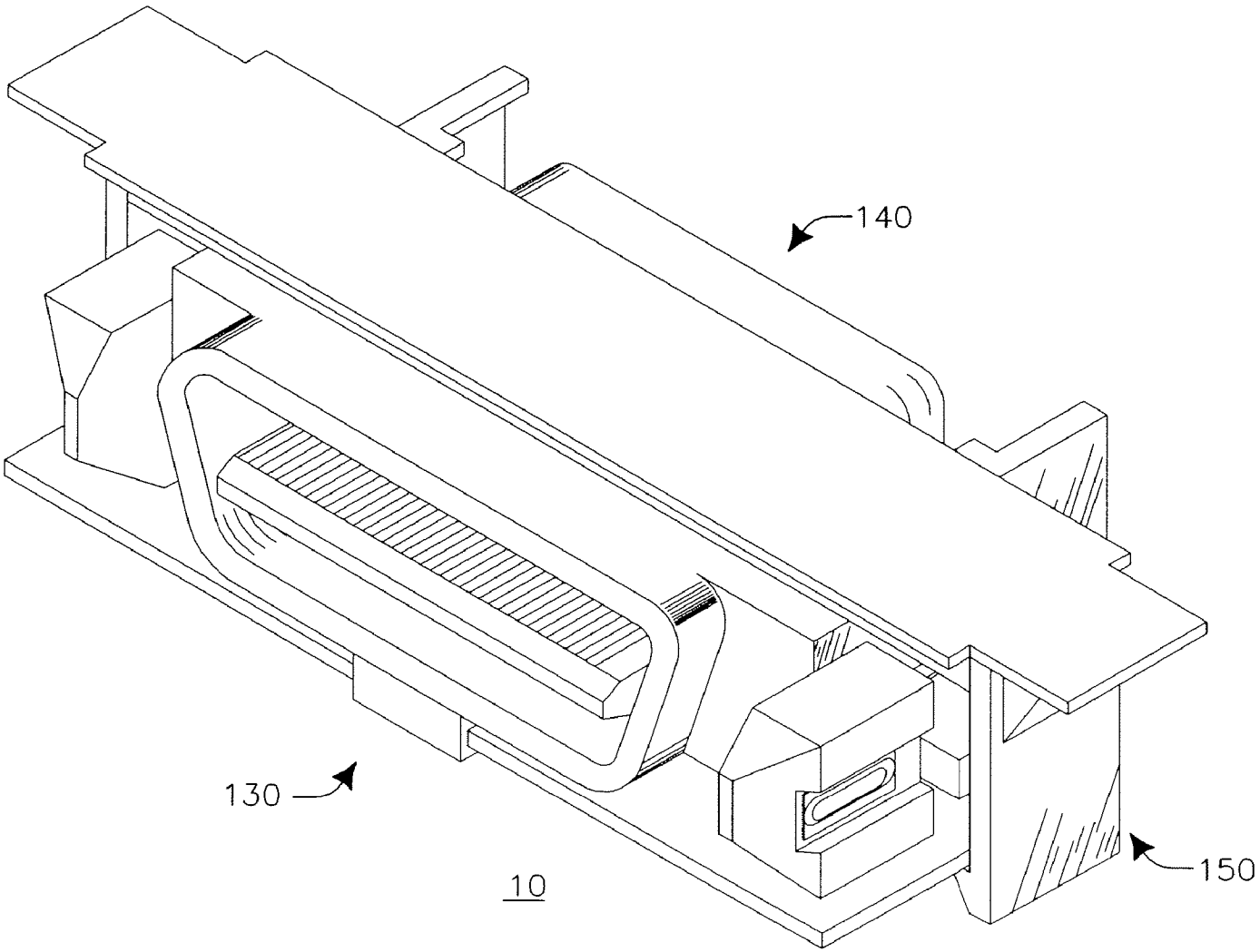
FIGS. 1A and 1B are isometric and exploded views, respectively, of an example disk drive interposer.

As shown in FIG. 1A a disk drive interposer 10 may generally include a plug connector side 130, a receptacle connector side 140 and a rail support cover 150.

Figure 1B:
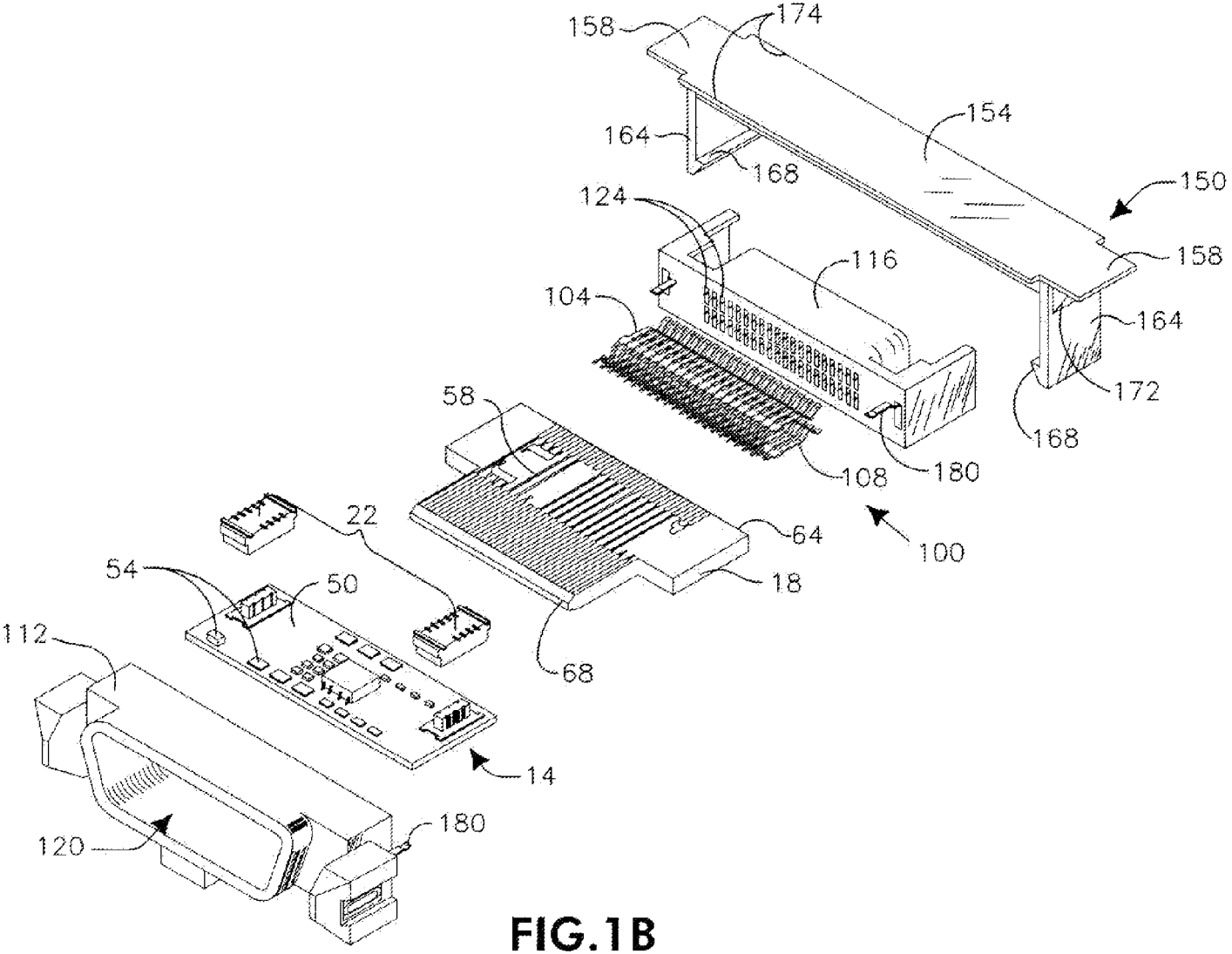

As shown in the FIG. 1B, the disk drive interposer 10 may include a component board assembly 14 and an interconnect board 18. The component board assembly 14 may define a plane and the interconnect board 18 may define a plane. The component board assembly and the interconnect board may be interconnected via a mezzanine connector 22. A mezzanine connector 22, as that term is used herein, refers to an electrical connector having a mating face that defines a mating plane and a mounting face (not shown) that defines a mounting plane, wherein the mounting plane may be parallel to the mating plane. An example of such a mezzanine connector 22 is the CONAN connector, which is available from FCI, a leading supplier of connectors and interconnect systems. Accordingly, when connected via a mezzanine connector 22, the planes defined by the component board assembly 14 and the interconnect board 18 may be parallel.

The component board assembly 14 may include a circuit board 50, which may be a printed circuit board (PCB). The circuit board 50 may be a multi-layer circuit board (e.g., the circuit board 50 may be a four-layer PCB). The component board assembly 14 may include any number of electrical or electronic components 54 affixed to the top layer of the circuit board 50. Examples of such components 54 include integrated circuits, memory chips, microprocessors, power supplies, etc. The components 54 may be affixed to the top layer of the circuit board 50 using any available surface-mount or through-mount technology (SMT/TMT). The components 54 may be electrically interconnected via a pattern of electrically-conductive (e.g., solder) traces disposed on the surfaces of the layers of the board. The traces on the several layers may be interconnected via vias, as is well-known in the art.

The interconnect board 18 may be a circuit board, which may be a printed circuit board (PCB). The circuit board may be a multi-layer circuit board (e.g., the circuit board may be a four-layer PCB). The interconnect board 18 may include a pattern of electrically-conductive (e.g., solder) traces 58 disposed on the surfaces of the layers of the board. The traces 58 on the several layers may be interconnected via vias, as is well-known in the art. The interconnect board 18 may define a backplane edge 64, for mating with a backplane (or midplane) connector (not shown), and a disk-drive edge 68, for mating with a disk-drive connector (not shown).

Figure 2A:
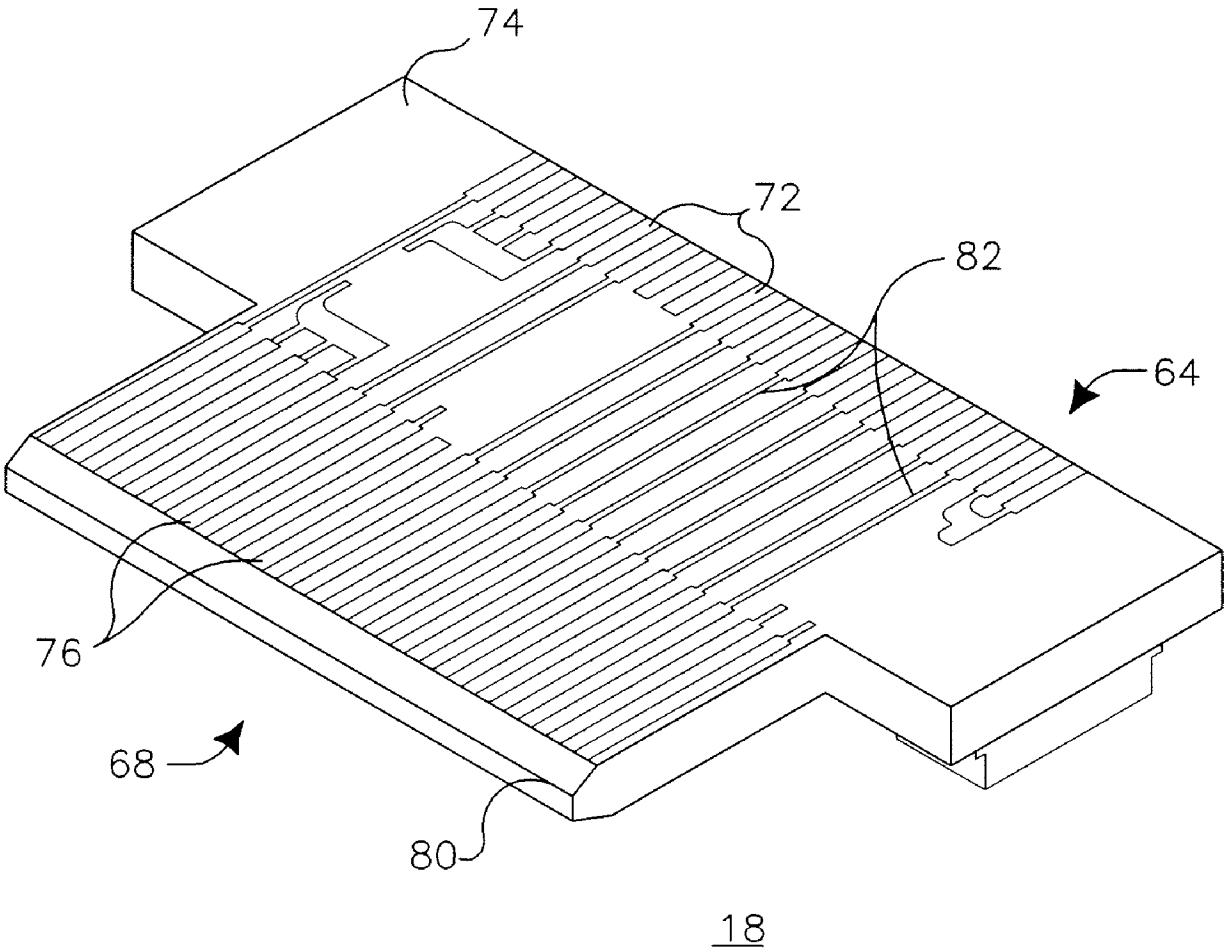
FIGS. 2A and 2B are isometric views depicting an example trace pattern for a multi-layer interconnect board.
Figure 2B:
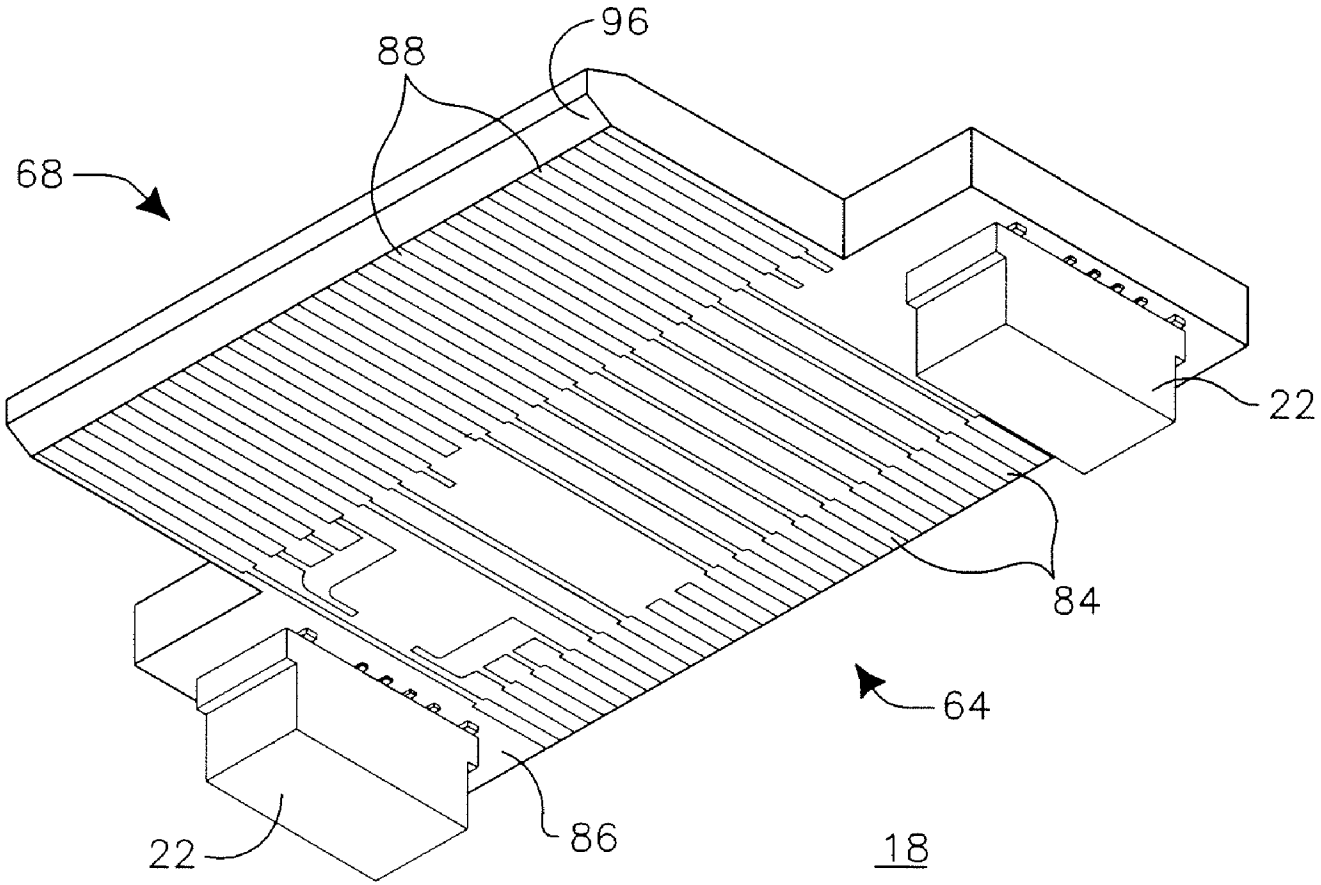

FIGS. 2A and 2B depict an example trace pattern for a multi-layer interconnect board 18. As shown in FIG. 2A, the interconnect board 18 may include a first plurality of electrically-conductive pads 72, which may be disposed on the top layer of the interconnect board 18. The first plurality of pads 72 may extend as a first linear array along a first edge 74 of the top layer of the interconnect board 18. The interconnect board 18 may include a second plurality of electrically-conductive pads 76, which may be disposed on the top layer of the interconnect board 18. The second plurality of pads 76 may extend as a second linear array along a second edge 80 of the top layer of the interconnect board 18. The second edge 80 may be opposite the first edge 74. The interconnect board 18 may include a first plurality of traces 82, which may be disposed on the top layer of the interconnect board 18. Each of the first plurality of traces 82 may extend across the top layer of the interconnect board 18, and interconnect a surface pad 72 from the first array with a corresponding surface pad 76 from the second array.

As shown in FIG. 2B, a third plurality of surface pads 84 may be disposed on the bottom of the circuit board. The third plurality of pads 84 may extend as a third linear array along a third edge 86 of the bottom of the interconnect board 18. The first and third pad arrays 72 and 84 may be disposed on the backplane edge 64 of the interconnect board 18. A fourth plurality of surface pads 88 may be disposed on the bottom of the interconnect board 18. The fourth plurality of pads 88 may extend as a fourth linear array along a fourth edge 96 of the bottom of the circuit board. The fourth edge 96 may be opposite the third edge 86. The second and fourth pad arrays 76 and 88 may be disposed on the disk-drive edge 68 of the interconnect board 18.

A linear array of electrically-conductive receptacle contacts 100 may be affixed to the first array of pads 72 and to the third array of pads 84. The receptacle contacts 100 may be dual beam contacts, such as Single Connector Attach (SCA-2) contacts. A first beam 104 of each receptacle contact 100 may be affixed to a respective pad 72 in the first pad array. A second beam 108 of each receptacle contact 100 may be affixed to a respective pad in the third pad array 84. The receptacle contacts 100 may be affixed to the pads using any available technique. For example, the receptacle contacts 100 may be "microjoined" to the pads.

Thus, the interconnect board 18 may define a disk-drive mating edge 68 having one or more pluralities of electrically-conductive pads, each of which is adapted to make electrical contact with a respective receptacle contact from a connector affixed to a mating edge of a disk drive (not shown) as the interposer 10 receives the disk drive. The interconnect board 18 may also define a backplane mating edge 64 opposite the disk-drive mating edge 68. The backplane mating edge 64 may include a plurality of receptacle contacts 100, each of which is adapted to engage a respective plug contact from a backplane connector as the interposer 10 is seated onto a backplane (or midplane). As shown, the interposer 10 may include 40 SCA-2 contacts, 20 in each of the top and bottom arrays.

The interposer 10 may include a plug housing 112 and a receptacle housing 116. The plug housing 112 may define a cavity 120 extending therethrough. The disk-drive edge 68 of the interconnect board 18 may extend into the cavity 120. The receptacle housing 116 may define a plurality of apertures 124 extending therethrough. Each of the receptacle contact beams 104 and 108 may extend through a respective one of the apertures 124.

The disk drive may include a receptacle connector that would ordinarily mate with a complementary plug connector on the backplane. As shown in FIG. 1A, the interposer 10 may include the plug connector side 130, which may be adapted to connect to the disk drive receptacle connector. The interposer 10 may also include the receptacle connector side 140 opposite the plug connector side 130. When the disk drive, with the interposer 10 connected to the disk drive receptacle connector, is seated into the backplane, the interposer receptacle connector side 140 will mate with the backplane plug connector, just as the receptacle connector of the disk drive would if the interposer 10 were not present. Thus, the interposer 10 may physically and electrically "mimic" the disk drive from the frame of reference of the backplane, and may physically and electrically "mimic" the backplane from the frame of reference of the disk drive. Consequently, the interposer 10 enables a system (i.e., the disk drive with interposer 10 connected) that can be customized with hardware and software for a particular application (via the component board assembly 14), without the need for the disk drive itself to be customized (i.e., a standard, off-the-shelf disk drive may be used).

The interconnect board 18 may include a pattern of electrically-conductive traces for interconnecting the pad arrays with the contacts in the mezzanine connector 22. Thus, the disk drive, the component board assembly 14, and the backplane may be interconnected.

The interposer 10 may include a rail support cover 150. The rail support cover 150 may include a rail support member 154. The rail support member 154 may have opposing distal ends 158 that extend beyond the sides of the rest of the interposer 10. The distal ends 158 may be adapted to be received by the rails along which the disk drive typically slides as it is seated into the backplane. The length of the rail support member 154 may be selected to ensure a snug, but not too snug, fit between the rails. The thickness of the distal ends 158 may be selected to ensure a snug, but not too snug, fit within the rails.

The rail support cover 150 may include a pair of resilient arms 164 extending from the underside of the rail support member 154. The arms 164 may cooperate to hold the interconnect board 18, the mezzanine connectors 22, and the component board assembly 14 together. Each arm 164 may have a latch 168 that sets under the bottom of the component board assembly 14, thereby pulling the component board assembly 14 (and, consequently, the mezzanine connectors 22 and the interconnect board 18) toward the underside of the rail support member 154. Thus, the component board assembly 14, the mezzanine connectors 22, and the interconnect board 18 may be pressed together. The rail support member 154 may include a respective buttress 172 corresponding to each of the arms 164 to keep the arms 164 from spreading out too far in the direction away from the boards, so that the lip of the latch 168 remains under the interconnect board 18. Thus, the rail support cover 150 may function to hold the several parts of the interposer 10 together, as well as to enable the interposer 10 to slide.

The top surface of the rail support member 154 may be flush with the top surfaces of the plug housing 112 and the receptacle housing 116. The rail support member 154 may include a respective protrusion 174 along each longitudinal edge. Each of the plug housing 112 and the receptacle housing 116 may include respective grooves (not shown) to receive the protrusions 174, thereby holding the plug housing 112 and receptacle housing 116 to the rail support cover 150. Alternatively, the interposer 10 may include a latch system that extends through the interposer 10, from the plug housing 112 to the receptacle housing 116, to hold the plug 112 and receptacle 116 housings together.

Each of the plug 112 and receptacle 116 housings may include one or more electrostatic discharge (ESD) contacts 180 extending therefrom. The receptacle housing 116 ESD contact 180 may make electrical contact with the ground plane of the backplane. When the plug 112 and receptacle 116 housings are held into place as part of the interposer 10, the ESD contacts 180 from the plug housing 112 engage the ESD contacts 180 from the receptacle housing 116.

What is claimed:

1. A disk drive interposer, comprising:

a component board assembly having a plurality of electrical components electrically connected by a first set of electrically conductive traces;

an interconnect board having a first plurality of electrically-conductive pads disposed along a disk drive mating edge of the interconnect board and a second plurality of electrically-conductive pads disposed along a backplane mating edge of the interconnect board, wherein the first plurality of pads is electrically connected to the second plurality of pads by a second set of electrically conductive traces; and at least one mezzanine connector electrically interconnecting the first set of traces and the second set of traces.

2. The disk drive interposer of claim 1, further comprising a plug housing that defines a cavity extending therethrough, the interconnect board extending into the cavity such that the first plurality of pads is positioned in the cavity.

3. The disk drive interposer of claim 2, further comprising an electrostatic discharge contact extending from the plug housing.

4. The disk drive interposer of claim 1, further comprising a plurality of receptacle contacts, each of which is affixed to a respective one of the pads in the second plurality of pads.

5. The disk drive interposer of claim 4, further comprising a receptacle housing having a plurality of apertures, wherein a respective one of the receptacle contacts extends through a respective one of the apertures.

6. The disk drive interposer of claim 5, further comprising an electrostatic discharge contact extending from the receptacle housing.

7. The disk drive interposer of claim 1, further comprising a rail support cover comprising a rail support member having an opposing pair of distal ends, each of which is adapted to slidingly engage a complementary rail, wherein the rail support cover holds the component board assembly, the at least one mezzanine connector and the interconnect board together.

8. The disk drive interposer of claim 7, further comprising a pair of resilient arms extending from a bottom surface of the rail support member, each said arm terminating in a latch tip that engages a bottom surface of the component board assembly.

9. The disk drive interposer of claim 8, further comprising a respective buttress corresponding to each of the arms to keep the arms from spreading out too far in the direction away from the boards.

10. A disk drive interposer having a plug connector side and a backplane connector side, the disk drive interposer comprising:

a component board assembly;

an interconnect board; and at least one mezzanine connector that electrically interconnects the interconnect board to the component board, wherein the interconnect board at least partially defines the plug connector side of the interposer and the backplane connector side of the interposer.

11. The disk drive interposer of claim 10, further comprising a plug housing that defines a cavity therethrough, wherein (i) the interconnect board comprises a first plurality of electrically-conductive pads disposed along a disk drive mating edge of the interconnect board and a second plurality of electrically-conductive pads disposed along a backplane mating edge of the interconnect board, and (ii) the interconnect board extends into the cavity of the plug housing such that the first plurality of pads is positioned in the cavity.

12. The disk drive interposer of claim 11, further comprising a receptacle housing; and a plurality of receptacle contacts, each of which is affixed to a respective one of the pads of the second plurality of pads, wherein the receptacle contacts extend through the receptacle housing.

13. The disk drive interposer of claim 10 further comprising a rail support cover comprising a rail support member having an opposing pair of distal ends, each of which is adapted to slidingly engage a complementary rail, wherein the rail support cover holds the component board assembly, the at least one mezzanine connector and the interconnect board together.

14. The disk drive interposer of claim 13, further comprising a pair of resilient arms extending from a bottom surface of the rail support member, each said arm terminating in a latch tip that engages a bottom surface of the component board assembly.

15. The disk drive interposer of claim 14, further comprising a respective buttress corresponding to each of the arms to keep the arms from spreading out too far in the direction away from the boards.

16. The disk drive interposer of claim 10, wherein the component board assembly includes a plurality of electrical components.

17. A disk drive interposer comprising:

a component board assembly;

at least one mezzanine connector; and an interconnect board electrically connected to the component board assembly by the mezzanine connector, wherein the interconnect board defines a receptacle connector along a backplane mating edge and a plug connector along a disk drive mating edge;

the interposer physically and electrically mimics a disk drive from the frame of reference of a backplane, and physically and electrically mimics the backplane from the frame of reference of the disk drive.

18. The disk drive interposer of claim 17, further comprising a rail support cover comprising a rail support member having an opposing pair of distal ends, each of which is adapted to slidingly engage a complementary rail, wherein the rail support cover holds the component board assembly, the at least one mezzanine connector and the interconnect board together.

19. The disk drive interposer of claim 17, further comprising a pair of resilient arms extending from a bottom surface of the rail support member, each said arm terminating in a latch tip that engages a bottom surface of the component board assembly.

20. The disk drive interposer of claim 18, further comprising a respective buttress corresponding to each of the arms to keep the arms from spreading out too far in the direction away from the boards.

21. A disk drive interposer configured for connecting a backplane to a disk drive, the disk drive interposer comprising:

a first electrical connector housing configured to mate with the backplane, and a second electrical connector housing configured to mate with the disk drive;

an interconnect member having a first set of electrically conductive members that extend toward the first electrical connector housing, and a second set of electrically conductive members that extend toward the second electrical connector housing; and a printed circuit board electrically connected to the interconnect member, wherein the first electrical connector housing is mounted onto the printed circuit board such that the first set of electrically conductive members is disposed at a mating end of the first electrical connector housing, a support member that retains the interconnect member at a location between the printed circuit board and the support member.

22. The disk drive interposer as recited in claim 21, wherein the interconnect member is disposed above the printed circuit board, and the support member includes a pair of opposing arms that engage a bottom surface of the printed circuit board.

23. The disk drive interposer as recited in claim 22, wherein the engagement of the arms and the bottom surface of the printed circuit board retains the printed circuit board against the interconnect member.

24. The disk drive interposer as recited in claim 21, further comprising a set of electrical contacts extending into the second electrical connector housing, wherein the second set of electrically conductive members are electrically connected to the set of electrical contacts.

25. The disk drive interposer as recited in claim 21, wherein the mating end of the first electrical connector housing is configured to mate with the backplane.

26. The disk drive interposer as recited in claim 25, further comprising an electrical plug connector that includes the first electrical connector housing.

27. The disk drive interposer as recited in claim 21, further comprising an electrical receptacle connector that includes the second electrical connector housing.

* * * * *